United States Patent [19]

Bertail

[11] 3,937,301

[45] Feb. 10, 1976

[54] TRAILER HAVING A SELF-LIFTING PLATFORM

[76] Inventor: Philippe Bertail, 13, Avenue Rhin et Danube, 92350 La Garenne Colombes, France

[22] Filed: Mar. 18, 1974

[21] Appl. No.: 452,777

[30] Foreign Application Priority Data

Mar. 20, 1973 France ..... 73.09884

[52] U.S. Cl. ..... 187/19; 182/63; 182/141; 187/9 R

[51] Int. Cl.[2] ..... B66B 11/04

[58] Field of Search ..... 187/2, 9, 17, 19, 95; 182/63, 131, 141, 178; 52/637, 638, 655; 254/95, 97

[56] References Cited

UNITED STATES PATENTS

| | | | |
|---|---|---|---|
| 668,627 | 2/1901 | Crow | 187/19 X |
| 3,516,512 | 6/1970 | Kupke et al. | 182/63 X |
| 3,606,251 | 9/1971 | Willke et al. | 254/95 X |
| 3,804,208 | 4/1974 | Iida | 187/19 |
| 3,866,717 | 2/1975 | Johansson | 187/19 |

FOREIGN PATENTS OR APPLICATIONS

| | | | |
|---|---|---|---|
| 976,881 | 12/1964 | United Kingdom | 182/141 |

OTHER PUBLICATIONS

"Alimatic Mammoth 3200," Linden-Alimak Co. Publication, 4 Pages, March, 1972.

*Primary Examiner*—Evon C. Blunk
*Assistant Examiner*—James L. Rowland
*Attorney, Agent, or Firm*—John J. Dennemeyer

[57] ABSTRACT

A trailer is provided with a self-lifting platform and comprises a vertical mast having vertical lifting supports spaced in the longitudinal direction of the trailer. Each lifting support carries a toothed rack and symmetrical independent lifting mechanisms for actuating roller stars which are in engagement with the rack teeth.

7 Claims, 4 Drawing Figures

TRAILER HAVING A SELF-LIFTING PLATFORM

Figure 1:
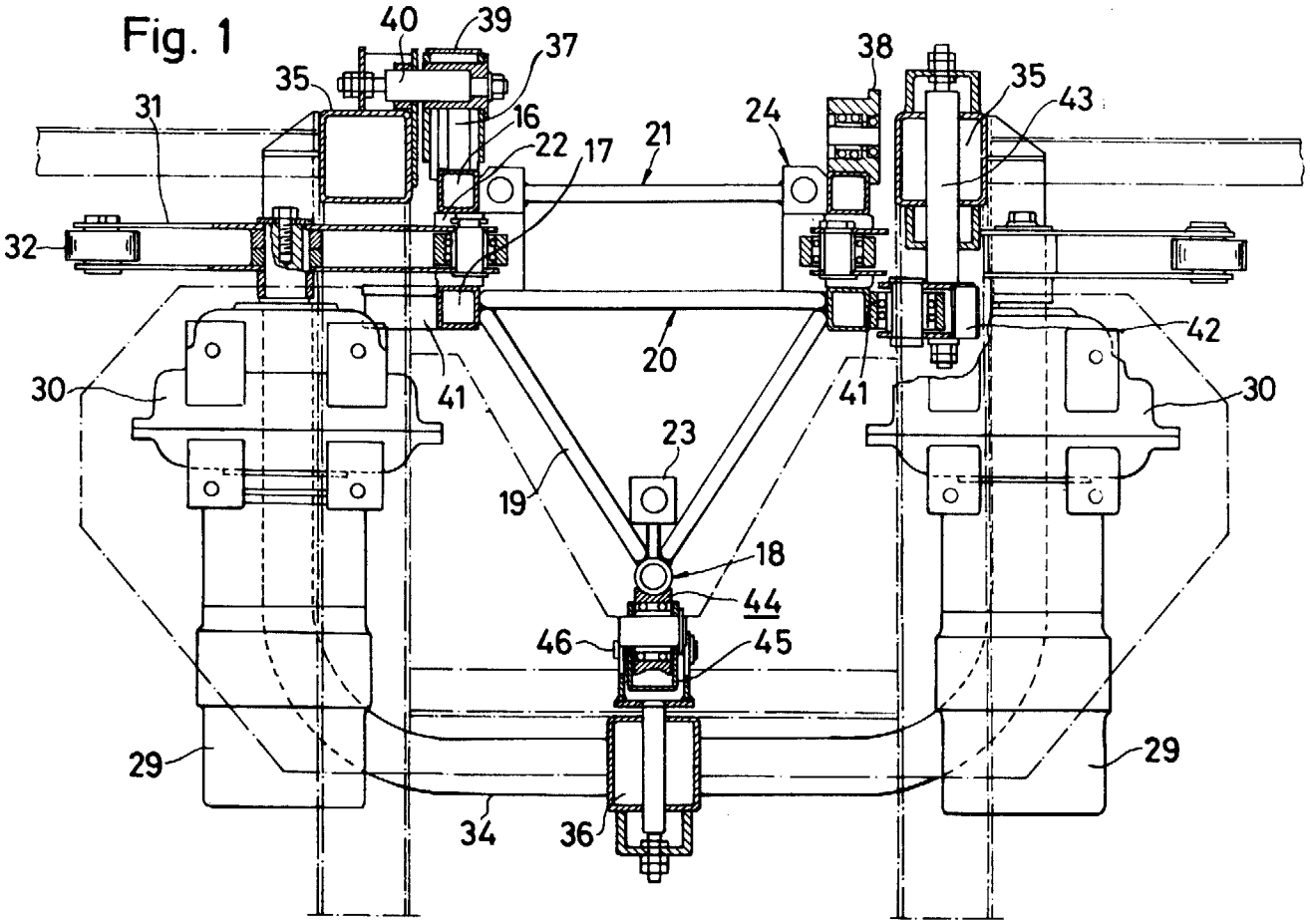

The present invention relates to an apparatus which can be utilized in many working operations and comprises a working platform which is mounted on a trailer and is capable of being rapidly moved to varying height positions. Accordingly it has already been suggested to employ trailers comprising a self-lifting platform, a vertical lifting mast rigidly fixed to the frame of the trailer and serving as support and as guide for the platform, and comprising elements which may be superimposed, and stabilizers for maintaining the trailer rigidly in the desired position.

In the known apparatus of this type the lifting of the platform is accomplished mainly by a geared motor disposed horizontally below the platform. The motor drives a gear plate which is in engagement with the vertical rack that is integral with an upright element of the mast, formed by teeth fixed in cantilevered fashion to the outer face of the mast. It has also been proposed in order to obtain a certain safety of operation to utilize two symmetrically disposed plates which are in engagement with two racks formed by teeth also mounted in cantilivered fashion on two outer faces of the same upright element of the mast.

It is, however, evident that such a construction exerts high mechanical loads on the racks and on the mast which require therefore strong and consequently heavy structures for the racks. In addition, a very exact machining which is also very expensive is required to make the movement of the platform less uneven and somewhat more uniform, and nevertheless this does not assure a perfect movement of the platform. An imperfect equilibrium of the frame, in addition to the abovementioned disadvantages, contributes to make the stability of the entire construction precarious under certain conditions and due to this fact the admissible lifting height of the platform is limited.

Accordingly it is an object of the present invention to eliminate these disadvantages by constructing a trailer with a self-lifting platform based on a more rational conception of the mast to permit by a better distribution of the loads a better guiding and a perfect equilibrium of the platform. It becomes therefore also possible to provide on the one hand a considerably increased lifting height of the platform and on the other hand a decreased height of the guide elements of the platform which permits to lower the platform to a position closer to the ground, for example to about one meter, so as to make the access and use of the platform more convenient. Finally, the better distribution of the loads results in a simpler construction and permits the use of lighter elements to obtain an important reduction of the costs of manufacture.

An embodiment of the invention is illustrated in the trailer to be described hereinafter and comprises:

a. a frame carried on pneumatic wheels and provided with four pivotable stabilizers;

b. a lifting mast fixed to the frame and consisting of superimposable elements and two racks mounted thereon;

c. a self-lifting platform guided along the mast by five sets of two superimposed roller carriages;

d. two geared motors integral with the platform and driving two roller stars in engagement with the racks.

The desired results are actually obtained in such an embodiment of the invention by the fact that the first element of the mast consisting of superimposable elements is integral with two uprights of the trailer located on both sides of the shaft wheels and set into the frame. Each element of the mast is in turn also fixed rigidly to the preceding element of the mast, and the mast consists substantially of two vertical lifting supports formed each by square-shaped tubes which are spaced in the longitudinal direction of the trailer. Each of the tubes is rigidly fixed to one of the two uprights set into the frame on both sides of the trailer shaft, and each of these double lifting supports comprises the elements of the toothing of a rack. These elements consist of sheet metal stamped in a press and fixed at their ends to the two tubes of which each if the two lifting supports is composed, and two roller stars cooperate with these rack elements and are driven completely independently by two geared motors which are disposed symmetrically with regard to the two lifting supports such that each extends into one lifting support respectively. Two superimposed guide roller carriages, all located in the same plane and carried by the structure of the platform roll along each of the tubes forming the lifting supports and along an additional tubular stiffening upright of the mast, integral with the lifting supports and the frame. The frame is provided at each of its corners with a stabilizer pivotably mounted on the frame and provided at its free end with a ground engaging hoist.

Figure 2:
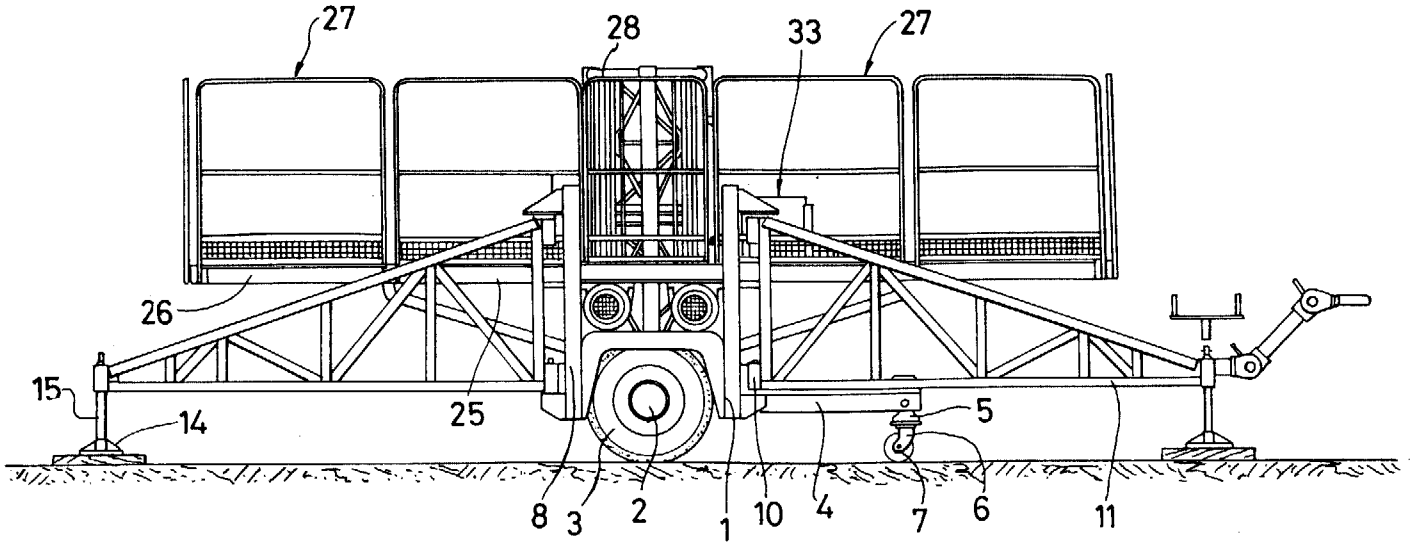
Figure 3:
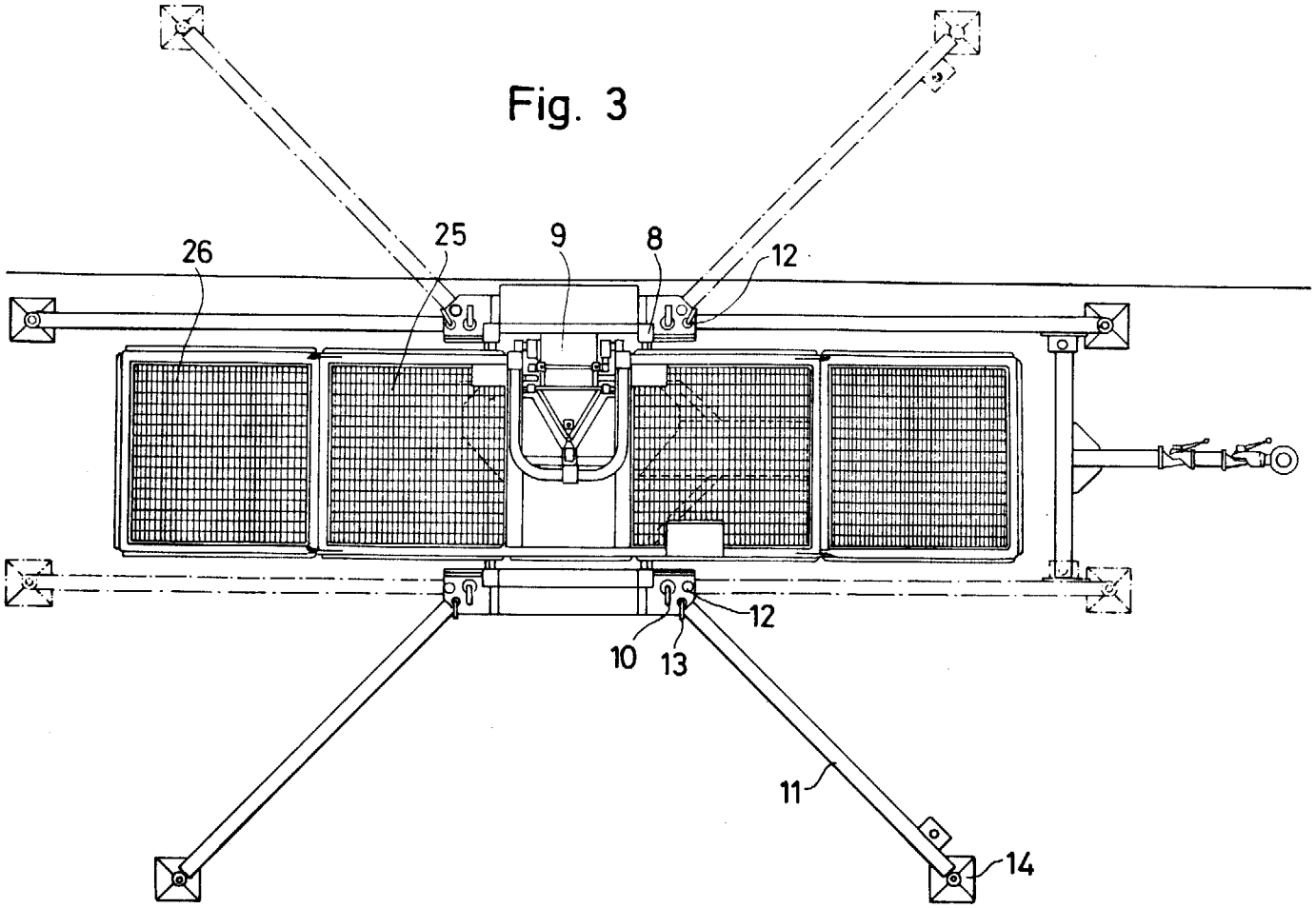
Figure 4:
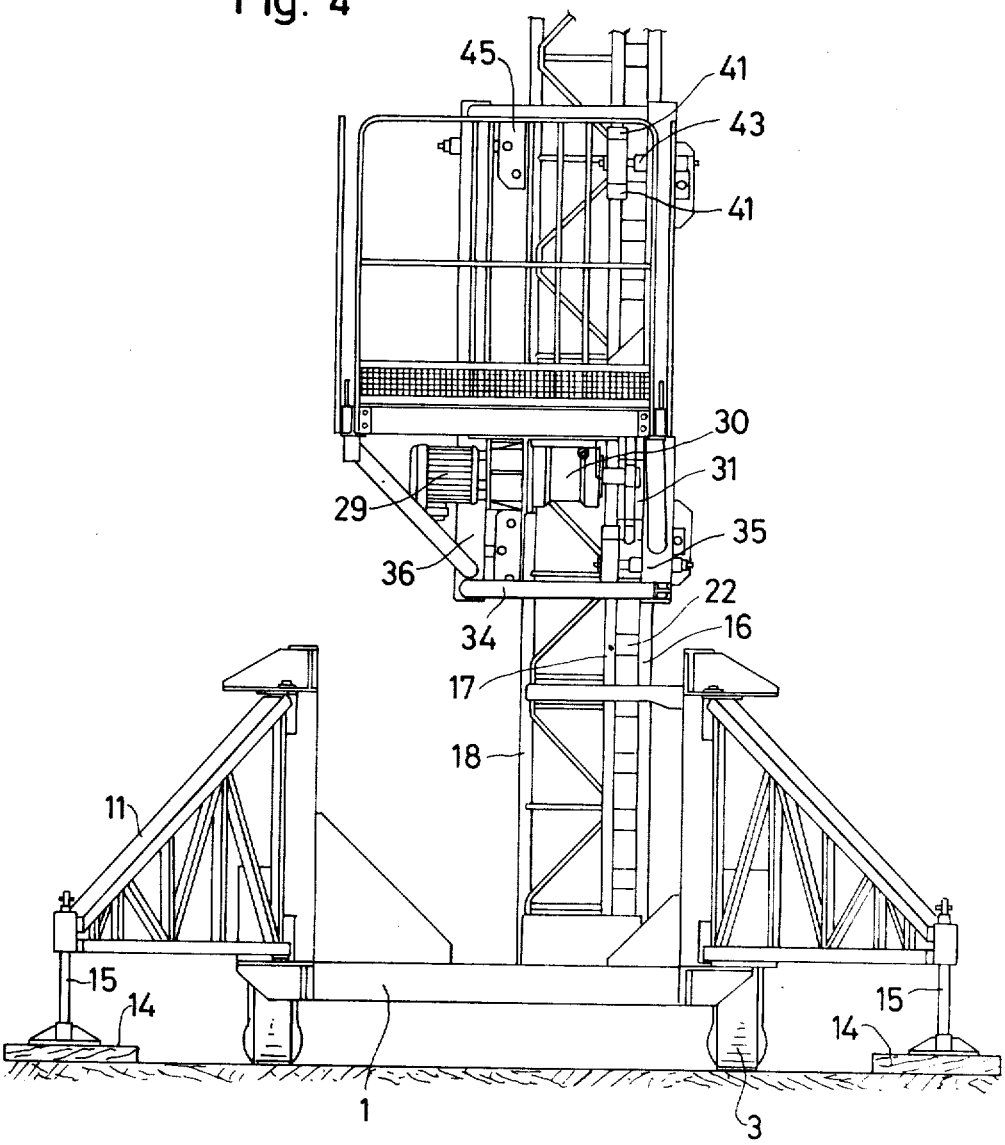

To more thoroughly explain the invention one embodiment will be described hereinafter in more detail by referring to the drawings, wherein:

FIG. 1 is a horizontal section through the mast, the guide means and the drive of the self-lifting platform, FIG. 2 is a side view of the trailer, FIG. 3 is a plan view of the same trailer, FIG. 4 is a partial view in elevation showing two pairs of guide rollers of the platform in cooperation with a lifting support and the stiffening upright.

The rectangular frame 1 is carried on a shaft 2 with tire wheels 3 and has at the forward end an axial prolongation 4 having a cup 5 wherein a clevis 6 of a small wheel 7 may pivot.

At each of the four corners of the frame an orientable stabilizer 11 is pivoted by means of a vertical shaft 10. Each stabilizer consists for example of a beam presenting a triangular framework provided at its free end with a support shoe 14 adjustable in height by the actuation of a screw hoist 15. These stabilizers 11 may be immobilized in one or the other of the two possible orientations, either during transport in a direction parallel to the longitudinal axis of the frame by levers threaded at 12 or, for the operation of the platform, in positions oriented at 45° with regard to the transport position by actuating the levers at 13.

In the frame four uprights 8 are mounted so as to be exactly symmetrical with respect to the shaft 2. Two of these uprights are mounted on both sides of the shaft 2 and are made integral with the lifting mast by means of a counterpiece 9.

The lifting mast consists of elements which may be superimposed, having for example a height of 1,5 m. Each of these elements is formed essentially, as it has been described already above, by two lifting supports spaced in the longitudinal direction of the trailer. Each support consists also of two tubular uprights of square shaped cross-section 16, 17, the uprights 16 being interconnected by inclined tubular struts 21, and similarly the uprights 17 by struts 20.

Between the uprights 16, 17 of the lifting supports the rack teeth 22 are welded at the two ends, each tooth 22 consisting for example, of a flat iron piece having for example a width of 80 mm and a thickness of 6 mm, and stamped in a press so that the tooth has the desired engagement profile.

So as to increase further the rigidity of the mast a supplemental upright 18 may additionally be used. It is shown as a tube of circular cross-section disposed on the prolongation of the small axis of the rectangle formed by the uprights 16, 17 of the lifting supports and connected to the uprights 16 respectively 17 by inclined tubular struts 19.

The assemblage of two superimposed elements of the mast is realized by means of two sets of three assembly pieces 23, 24 which are welded to the upper ends and to the lower ends, respectively, of the elements of the mast and connected together by means of three bolts.

The self-lifting platform is movable along the lifting mast and comprises a floor formed by a fixed central part 25 and by two detachable parts 26 located on the prolongation of the longitudinal axis of the central part, and a circumferential railing 27 provided with a door 28 having an electric lock which prevents all operation of the platform if the door is not perfectly closed.

The floor is supported from a structure 34 connecting three square-shaped vertical tubes, one such tube 36 being disposed in the central transverse plane and the other tubes 35 at the side of the platform in proximity of the mast and symmetrically with respect to this one tube.

On these square-shaped tubes of the structure 34 five sets of four guide rollers are mounted which roll on ball bearings and cooperate with the tubes 16, 17 of the lifting supports and with the stiffening tube 18, each set comprising two carriages of two superimposed rollers which may pivot on shafts 43 fixed at the upper and lower tube end portions of the structure.

More precisely: On each of the tubes 35 of the structure 34, in the two carriages 42 pivoting on the shafts 43 fixed at the upper and lower tube end portions, the rollers 41 are mounted which roll on the outer transverse faces of the tubes 17 of the lifting supports to assure the equilibrium of the platform in a longitudinal plane. On each of these same tubes 35, in the two carriages 39 pivoting on the shafts 40 fixed at the upper and lower tube end portions, the rollers 37 are mounted which roll on the longitudinal outer faces of the tubes 16 of the lifting supports, and on the tube 36 of structure 34, in the two carriages 45 pivoted on the shafts 46 at the upper and lower tube end portions, the rollers 44 are mounted which roll on the outer longitudinal face of the tube 18 so that the rollers 37 and 44 cooperate to assure the equilibrium of the platform in a transverse plane to prevent a movement of this platform in a transverse direction.

In addition, the rollers 37 are provided with a shoulder 38 abutting against the outer transverse faces of the tubes 16 of the lifting supports to prevent a rotation, even small, of the platform about the stiffening upright 18.

A perfect equilibrium and a safe guiding of the platform are therefore assured more particularly in consideration of the ease of engagement offered by the racks 18 for the roller stars.

The control of the platform is effected either during the raising or the lowering action by means of two geared motors comprising each an electric motor 29 and a speed reducer 30 as well as an electro-magnet brake controlled by interrupting the current. On the output shaft of each speed reducer 30 a supporting star is splined having six arms provided at their free ends with a roller 32 adapted to engage the teeth 22 of the corresponding rack. Due to the rotation of the stars 31 a cycloidal movement with regard to the mast is transmitted to the rollers and consequently the platform is raised or lowered depending on the direction of rotation of the stars 31. An electric box 33 fixed to the railing 27 permits the remote control of the geared motors under a voltage of 48V.

It is understood that the invention as it is defined by the following claims is not limited to the embodiment described above and shown in the accompanying drawnngs. A person skilled in the art could make a number of modifications or additions in the construction without leaving the scope of the invention.

What is claimed is:

1. In a trailer having a self-lifting platform supported by a rack mechanism and guided along a vertical mast consisting of superimposable elements and supported by the trailer, the improvement comprising: two vertical lifting supports which are part of the mast, said lifting supports being spaced in the longitudinal direction of the trailer, a plurality of struts spanning the space between the two vertical lifting supports to join said lifting supports together in the mast, said struts being arranged in regular, vertically spaced intervals along substantially the entire length of the mast, each lifting support including two, spaced, vertical uprights, a toothed rack associated with each lifting support, each toothed rack including a plurality of flat rack teeth, one end of each rack tooth being coupled with one vertical upright of the associated lifting support, the other end of each rack tooth being coupled with the other upright of the associated lifting support, each rack tooth thereby spanning the space between two uprights of each lifting support, the rack teeth of each toothed rack being vertically spaced along the associated lifting support, said platform being provided with two, symmetric, independent lifting mechanisms including two roller stars which are in engagement with the two toothed racks.

2. A trailer having a self-lifting platform according to claim 1, wherein said two vertical uprights of both of the two lifting supports define a portion of said mast having a rectangular cross-section, said mast also including a fifth upright.

3. A trailer having a self-lifting platform according to claim 2, wherein said trailer includes a transverse axle defining a forward side and a rearward side of said trailer, the mast being connected with two vertical members of the trailer, two of said uprights of said mast being located on the forward side and two others of said uprights being located at the rearward side of the trailer and carrying at the forward side and at the rearward side said toothed racks the teeth of which cooperate with the rollers of said vertically mounted roller stars of the platform, said platform being guided on each of the five uprights by plural pairs of superimposed rollers.

4. A trailer having a self-lifting platform according to claim 3, wherein the frame is provided at each of its corners with a stabilizer element adapted to pivot horizontally between a longitudinal position and a stabilisation position inclined at an angle with respect to the trailer, each stabilizer element being provided at its free end with a ground engaging hoist.

5. A trailer having a self-lifting platform according to claim 3, wherein each of said lifting mechanisms comprises a motor and a speed reducer, each lifting mechanism having a central, longitudinal axis, each lifting mechanism being so disposed that the central longitudinal axis thereof extends transversely with respect to the trailer, the longitudinal axis of one lifting mechanism being disposed forwardly of said two uprights located on the forward side of said trailer and the longitudinal axis of the other lifting mechanism being located rearwardly of said two other uprights located at the rearward side of said trailer.

6. A trailer having a self-lifting platform according to claim 1, wherein each roller star includes a plurality of radially outwardly extending arms, each arm having a free end at the radially outermost end thereof and a roller mounted on each arm adjacent the free end thereof, whereby rotation of each roller star causes the free ends of said arms to move between the teeth of one toothed rack to effect engagement of said rollers with said teeth.

7. A trailer comprising:

a. an elongated frame;

b. a vertically movable platform;

c. a rack mechanism supporting said platform;

d. a vertical mast along which said platform is guided;

e. said trailer including a transverse axle defining forward and rearward sides of said trailer;

f. two, spaced, vertical lifting supports in said mast, one being disposed on said forward side of said trailer, the other being disposed on said rearward side, and a plurality of struts spanning the space between the vertical uprights to join said uprights together in said mast, said struts being arranged in regular, vertically spaced intervals along substantially the entire length of said mast;

g. each lifting support including a pair of spaced vertical uprights spaced transversely with respect to the trailer frame, said pairs of vertical uprights defining a portion of said mast having a rectangular cross section;

h. a first rack mechanism coupled with said pair of uprights of said forward lifting support, said first mechanism including a plurality of flat tooth members, one end of each tooth member being coupled with one vertical upright of said forward lifting support, the other end of each tooth member being coupled with the other upright of said forward lifting support, each tooth member thereby spanning the space between the two uprights of said forward lifting support, the tooth members of said first rack mechanism being vertically spaced along said first lifting support;

i. a second rack mechanism coupled with said pair of uprights of said rearward lifting support, said second mechanism including, a plurality of flat, tooth members, one end of each tooth member being coupled with one vertical upright of said rearward lifting support, the other end of each tooth member being coupled with the other upright of said rearward lifting support, each tooth member thereby spanning the space between the two uprights of said rearward lifting support, the tooth members of said second rack mechanism being vertically spaced along said first lifting support;

j. first and second lifting mechanisms, each lifting mechanism comprising an electric motor and a speed reducer, each lifting mechanism being mechanically independent of the other and each having a longitudinal axis, both of said lifting mechanisms being symmetrically arranged with respect to said mast and being so arranged that their longitudinal axes extend transversely with respect to the trailer frame; the longitudinal axis of said first lifting mechanism being located forwardly of said forward lifting support and the longitudinal axis of said second lifting mechanism being located rearwardly of said rearward lifting support;

k. said first and second lifting mechanisms including, respectively, first and second roller stars, each roller star including a plurality of radially outwardly extending arms, each arm having a roller at the free end thereof;

l. said rollers of said first roller star co-operating with said tooth members of said first first rack mechanism, and said roller of said second roller star co-operating with said tooth members of said second rack mechanism to support said platform and move the same vertically along said mast.

* * * * *